US007798493B1

(12) United States Patent
Moore

(10) Patent No.: US 7,798,493 B1
(45) Date of Patent: Sep. 21, 2010

(54) BOARD GAME

(76) Inventor: Adrian R. Moore, 3005 Faircroft Way, Monroe, NC (US) 28110

( * ) Notice: Subject to any disclaimer, the term of this patent is extended or adjusted under 35 U.S.C. 154(b) by 349 days.

(21) Appl. No.: 11/977,296

(22) Filed: Oct. 24, 2007

Related U.S. Application Data

(60) Provisional application No. 60/876,111, filed on Dec. 21, 2006.

(51) Int. Cl.
*A63F 7/00* (2006.01)

(52) U.S. Cl. ..... 273/115; 273/109; 273/116; 273/118 R

(58) Field of Classification Search ..... 273/108–110, 273/113, 115, 116, 118 R, 119 R
See application file for complete search history.

(56) References Cited

U.S. PATENT DOCUMENTS 466,124 A * 12/1891 Wooster ..... 273/116
570,921 A * 11/1896 Feldhoff ..... 273/113
625,845 A * 5/1899 Killey ..... 273/110
854,031 A * 5/1907 Failor ..... 273/113
1,654,991 A * 1/1928 Muir ..... 273/115
1,768,016 A * 6/1930 Walker ..... 273/116
2,468,567 A * 4/1949 Mebride ..... 273/109
D169,672 S * 5/1953 Hopkins ..... D21/338
3,188,087 A * 6/1965 Larson, Jr. ..... 273/115
3,236,522 A * 2/1966 Brown ..... 273/110
3,251,600 A * 5/1966 Warnberg ..... 273/282.1
3,471,154 A * 10/1969 Saunders ..... 273/113
3,479,033 A * 11/1969 Crisafulli et al. ..... 273/113
3,502,335 A * 3/1970 Sholin ..... 473/588
3,539,188 A * 11/1970 Salverda ..... 273/110
3,556,527 A * 1/1971 Arnold et al. ..... 273/115
3,747,930 A * 7/1973 Barlow ..... 273/113
3,787,055 A * 1/1974 Kraemer ..... 273/110
3,879,039 A * 4/1975 Holden ..... 273/110
3,967,824 A * 7/1976 Lund ..... 273/110
4,055,341 A * 10/1977 Martinez ..... 463/69
4,257,600 A * 3/1981 Goldfarb ..... 273/110
4,537,402 A * 8/1985 Prather, Jr. ..... 273/116
5,242,165 A * 9/1993 Shubert ..... 273/118 R
5,435,555 A * 7/1995 Fuhrer et al. ..... 273/110
5,749,575 A * 5/1998 German ..... 273/113
2002/0008354 A1 * 1/2002 Lorenz et al. ..... 273/119 R
2007/0187887 A1 * 8/2007 Borg ..... 273/109

* cited by examiner

*Primary Examiner*—Raleigh W. Chiu

(57) ABSTRACT

A game for children or adults using a board and a ball provides entertainment and motor skill improvements. The board has a central depression for initially receiving the ball whereby the board is then manipulated to allow the ball to roll from the central depression to a distal groove. As the ball enters the distal groove, the board is manually "flipped" by the player to urge the ball from one end of the board to the other end where the ball is then directed by precise manual motions to reseat in the central depression. One or more individuals, each using a board and ball can play games and have contests for fun and enjoyment purposes.

6 Claims, 2 Drawing Sheets

BOARD GAME

This non-provisional patent application claims all benefits under 35 U.S.C. §119(e) of U.S. provisional patent application Ser. No. 60/876,111 filed 21 Dec. 2006, entitled "FAST-BALL", in the United States Patent and Trademark Office.

FIELD OF THE INVENTION

The invention herein pertains to a board game for entertainment purposes and particularly pertains to an individual using a uniquely configured game board. The game board has a central depression and opposing parallel side ramps or grooves for use in combination with a ball.

DESCRIPTION OF THE PRIOR ART AND OBJECTIVES OF THE INVENTION

Children, adults and the like can be pleasantly occupied for prolonged time periods by playing games. Many games are available, some of which are electronic while others employ mechanical devices and some traditional playing cards. It is of benefit to a game player for development and improvement of various rudimentary motor skills which can be used later in other games or occupational pursuits.

Standard games sometimes employ paddles with elastic tethered balls, while other games utilize yo-yos, bats or other devices. Many such games require an outdoor environment for safety purposes, while other indoor games can be expensive and difficult for young children to master.

Realizing the difficulties and disadvantages of currently available games the present invention was conceived and one of its objectives is to provide a board game which can be safely used indoors or outdoors which is relatively simple to learn both for adults and children of all ages.

It is still another objective of the present invention to provide a board game which utilizes a relatively inexpensive game board and ball.

It is yet another objective of the present invention to provide a board game which can be played by one or more individuals each utilizing a game board and ball.

It is a further objective of the present invention to provide a board game which has unlimited options for creating different games and challenges by the game players.

Various other objectives and advantages of the present invention will become apparent to those skilled in the art as a more detailed description is set forth below.

SUMMARY OF THE INVENTION

The aforesaid and other objectives are realized by providing a board game which can be played by one or more individuals each having a game board and a ball. The game board is formed in an octagonal shape for ease in holding and includes an upper and lower surface. A center depression is formed on each surface and is sized to receive the ball and allow it to rest therein when the game board is held in a stable, level or horizontal position. A pair of parallel ramps or grooves are also formed on each surface on opposing sides of the center depression which likewise have a radii to accommodate the diameter of the ball.

In use, a player holds the board in a relatively horizontal position with the ball placed in the center depression. By manually tilting or "shaking" the front of the board downwardly a sufficient degree, the ball will exit the depression and roll toward the front groove. Once the ball enters the front or distal groove the player then "flips" or rotates the board in a counterclockwise direction to cause the ball to "fly" upwardly and rearwardly, in an arc allowing the ball to land on the top surface of the game board between the center depression and the rear groove. With the ball moving thereabout, the player then attempts to direct the ball to the center depression by manual tilting/shaking of the game board. By moving the board in a to-and-fro motion the ball will again rest in the center depression after skilled manipulation. Thereafter the game can be restarted for another game cycle. By practicing the board movements, various motor skills such as hand/eye coordination, ambidexterity, quickness and concentration will develop and sharpen. The game objectives are subsequently more easily achieved by constant practice.

If two or more individuals are playing simultaneously a contest can be held with the winner being the player that can "flip" the board and cause the ball to reenter the center depression first. As the ball is not tethered to the board, a system of points can be developed which may include earning points for first receiving the ball within the center depression, preventing the ball from escaping the board and falling to the ground and for other game acts.

DETAILED DESCRIPTION OF THE PREFERRED EMBODIMENT AND OPERATION OF THE INVENTION

Figure 1:
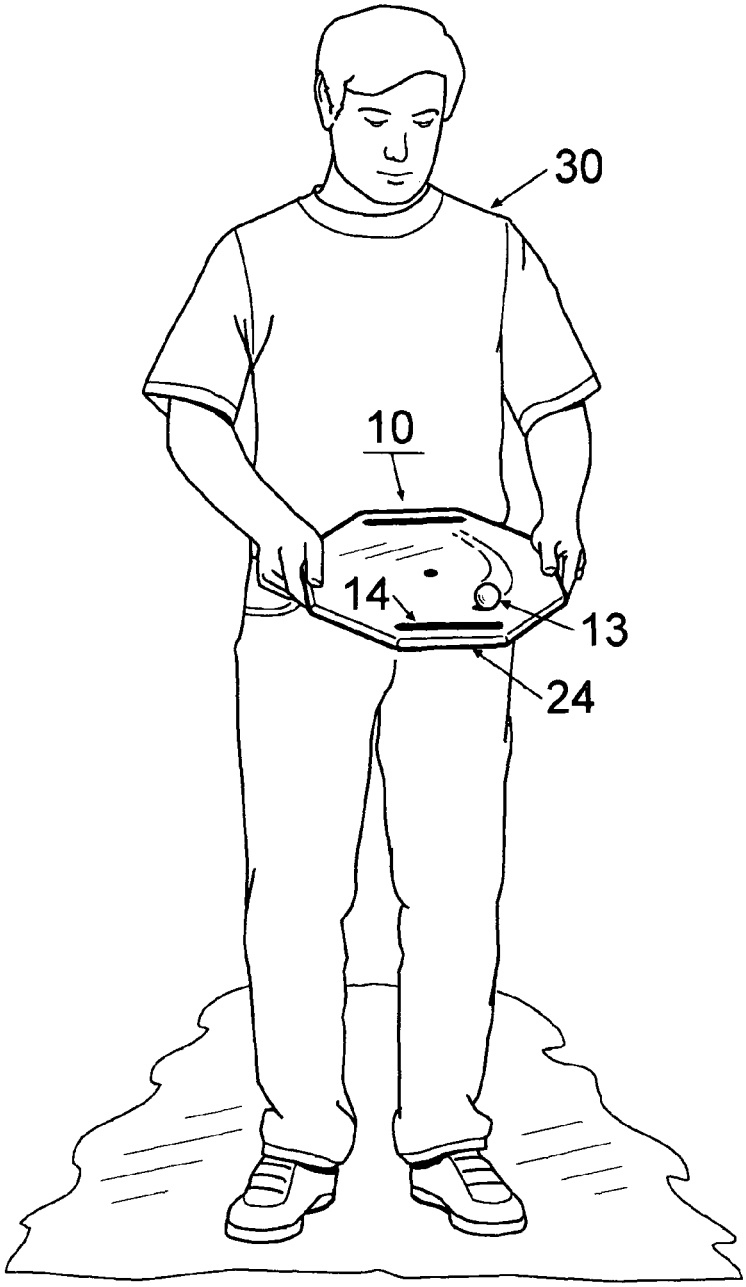
FIG. 1 shows a typical player with the ball in motion on the game board.

For a better understanding of the invention and its operation, turning now to the drawings, FIG. 1 shows the preferred form of game board 10 in perspective fashion as used by an individual such as player 30 for entertainment purposes. Game board 10 is seen tilted downwardly at its distal end 24 to direct ball 13 into ramp or groove 14. Ball 13 is preferably formed having a smooth, spherical shape from a plastic or finished wood and has a diameter of approximately 1.25 inches (3.175 cm). Game board 10 preferably has an octagonal shape for easy manual gripping and is approximately 13 inches (33 cm) in diameter with a thickness of approximately 1-1½ inches (2.54-3.8 cm), although it should be understood that the exact dimensions are somewhat variable depending on the particular needs and requirements of a particular manufacturer.

Figure 5:
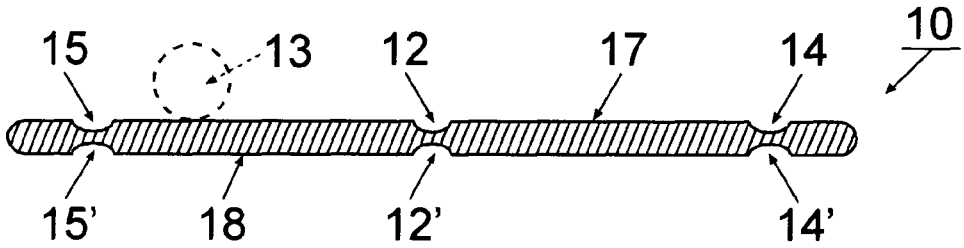
FIG. 5 is a cross-sectional view of the game board as shown in FIG. 2 along lines 5-5.
Figure 2:
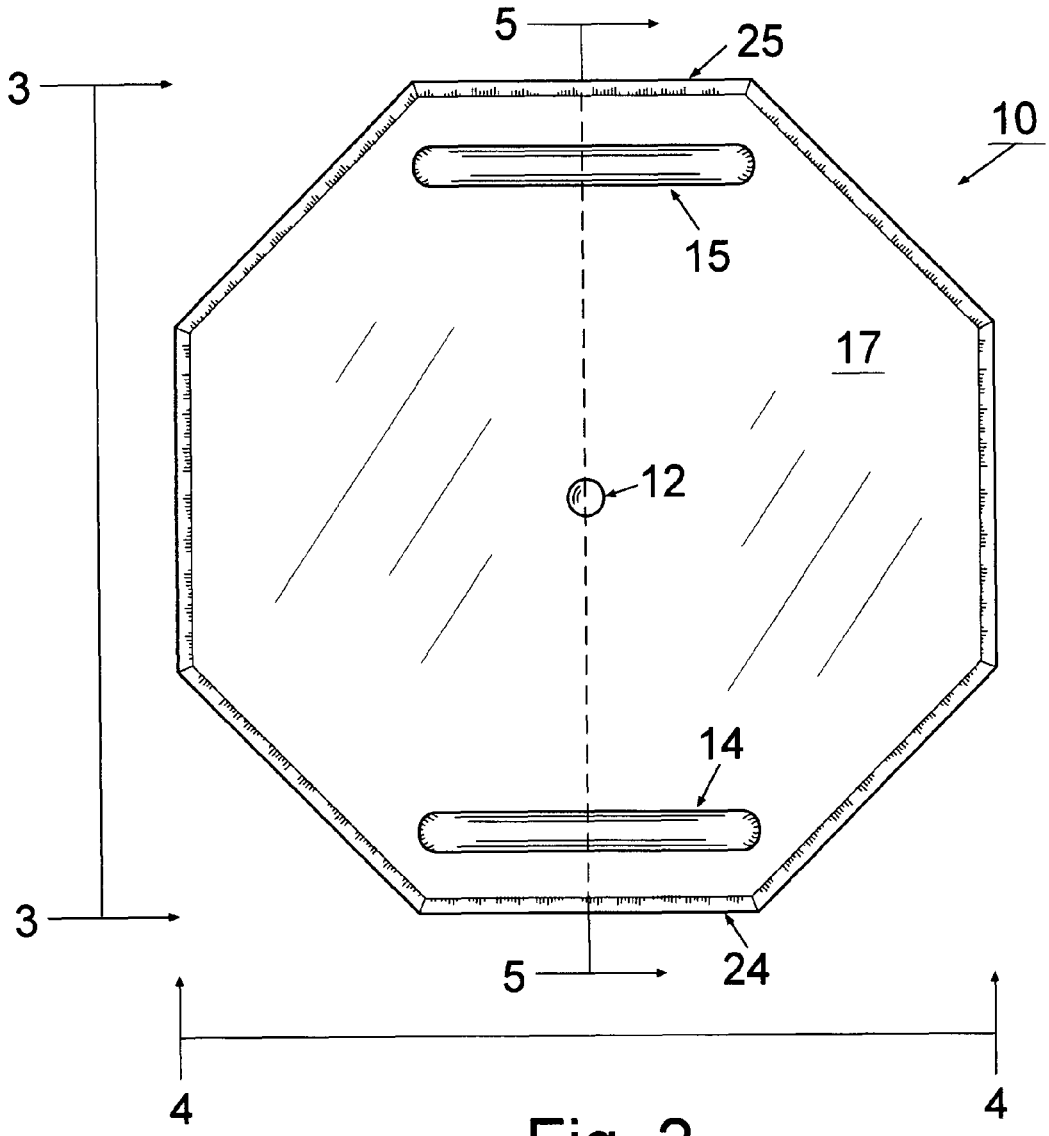
FIG. 2 is a top plan view of the game board with the ball removed therefrom, the bottom plan view being a mirror image thereof.
Figure 3:
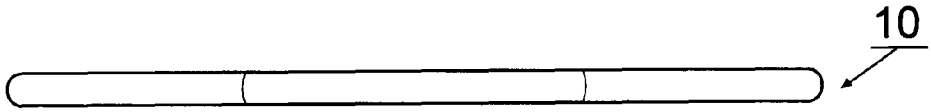
FIG. 3 is a left side elevational view of the game board as shown along lines 3-3 of FIG. 2, the right side elevational view of the game board being a mirror image thereof.
Figure 4:
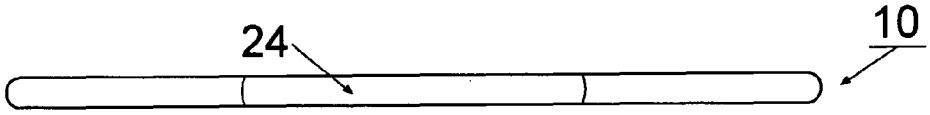
FIG. 4 is a front elevational view of the game board as shown along lines 4-4 of FIG. 2, the rear elevational view of the game board being a mirror image thereof.

Board 10 is formed from a smooth relatively inexpensive material such as a finished plywood, molded plastic or the like. As seen in FIGS. 2 and 5, board 10 includes top or upper surface 17 and bottom or lower surface 18. Upper surface 17 and lower surface 18 include respectively, center depressions 12, 12' which are circular and front and rear ramps or grooves 14, 15 and 14', 15' which are elongated and have arcuate cross-sections for smooth continuous entry and exit of ball 13. In FIG. 5 the relative diameter of grooves 14, 15 and center depression 12 are shown with ball 13 shown in imaginary fashion for a better understanding of the relative size of ball 13. FIG. 2, shows distal end 24 and opposite, proximal end 25 of game board 10. As also seen, grooves 14, 15 and 14', 15' are longer than the width of center depressions 12, 12'.

Many types of games and contests can be played with one or more individuals each having game board 10 and ball 13. The game is generally begun with a player, such as player 30 holding game board 10 in a relatively horizontal position and placing ball 13 in center depression 12 on top 17. Next, game board 10 is tilted downwardly as shown in FIG. 1 to allow ball 13 to roll toward groove 14 at distal end 24. As ball 13 comes to a rest in groove 14, the player "flips" board 10 causing ball 13 to exit groove 14 and fly in an arcuate path towards rear groove 15 near proximal end 25. The player "catches" ball 13 on top 17 of board 10 and then by specific manual manipulations causes ball 13 to roll toward center depression 12 where it will eventually rest therein. Once ball 13 rests in center depression 12, the playing cycle can be repeated as desired. The first player to achieve this is declared the "winner". Many other games can be derived by individual players for entertainment and fun.

The illustrations and examples provided herein are for explanatory purposes and are not intended to limit the scope of the appended claims.

I claim:

1. A game board comprising an upper surface, a lower surface, said upper surface spaced from said lower surface, said upper surface defining a depression and a pair of grooves, said upper surface depression positioned between said upper surface pair of grooves, said lower surface defining a depression and a pair of grooves, said lower surface depression positioned between said lower surface pair of grooves, a ball, said ball positioned on said upper surface.

2. The game board of claim 1 having an octagonal shape.

3. The game board of claim 1 wherein said upper surface pair of grooves defines a front groove, a rear groove, said upper surface front groove parallel to said upper surface rear groove.

4. The game board of claim 3 wherein said upper surface front groove has an arcuate cross-section, said arcuate cross-section configured to allow said ball to enter and exit said upper surface front groove in a smooth, continuous manner.

5. The game board of claim 3 wherein said upper surface front groove is longer than the width of said upper surface depression.

6. The game board of claim 1 wherein said upper surface is identical to said lower surface.

* * * * *